US005599123A

United States Patent [19]

Still

[11] Patent Number: 5,599,123

[45] Date of Patent: Feb. 4, 1997

[54] COMBINED PENCIL SHARPENER AND PENCIL STOWAGE APPARATUS

[76] Inventor: David W. Still, 8926 Yuba River Ave., Fountain Valley, Calif. 92708

[21] Appl. No.: 245,917

[22] Filed: May 19, 1994

[51] Int. Cl.[6] ..... B43K 29/06; B43K 29/02

[52] U.S. Cl. ..... 401/52; 15/105.53; 30/453; 30/451; 401/50; 401/131

[58] Field of Search ..... 401/131, 50, 51, 401/52; 15/105.53; 30/451, 453, 454, 458, 459

[56] References Cited

U.S. PATENT DOCUMENTS

| | | | |
|---|---|---|---|
| 627,279 | 6/1899 | Stassart . | |
| 965,235 | 7/1910 | Selleck | 15/105.53 |
| 1,200,575 | 10/1916 | Barrows | 30/459 |
| 1,214,996 | 2/1917 | Boye | 30/454 |
| 2,069,619 | 2/1937 | Mendelson | 30/459 |
| 2,333,714 | 4/1942 | Fletcher | 120/93 |
| 2,757,638 | 8/1956 | Goldstein | 120/1 |
| 5,205,664 | 4/1993 | Yushan et al. | 401/50 |

FOREIGN PATENT DOCUMENTS

| | | | |
|---|---|---|---|
| 1029451 | 6/1953 | France | 401/131 |
| 857915 | 12/1952 | Germany | 30/454 |
| 2535 | of 1890 | United Kingdom | 15/105.53 |

*Primary Examiner*—Steven A. Bratlie

[57] ABSTRACT

The present invention is a combined pencil sharpener and pencil stowage apparatus. The invention comprises a body, a pencil stowage compartment formed within the body for containing a tip of a pencil, and a separate pencil sharpener compartment formed within the body, the pencil sharpener compartment containing a pencil sharpener. Unlike previous inventions, the present invention provides a single body that has these two separate pencil stowage and pencil sharpener compartments formed therein. The pencil stowage compartment and pencil sharpener compartment are preferably positioned in a parallel relationship to minimize the length of the pencil/apparatus when the pencil is stowed in the apparatus, therefore making it easy to be stored in the user's pocket.

11 Claims, 1 Drawing Sheet

FIG. 2
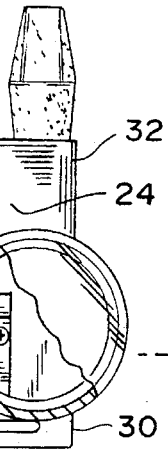
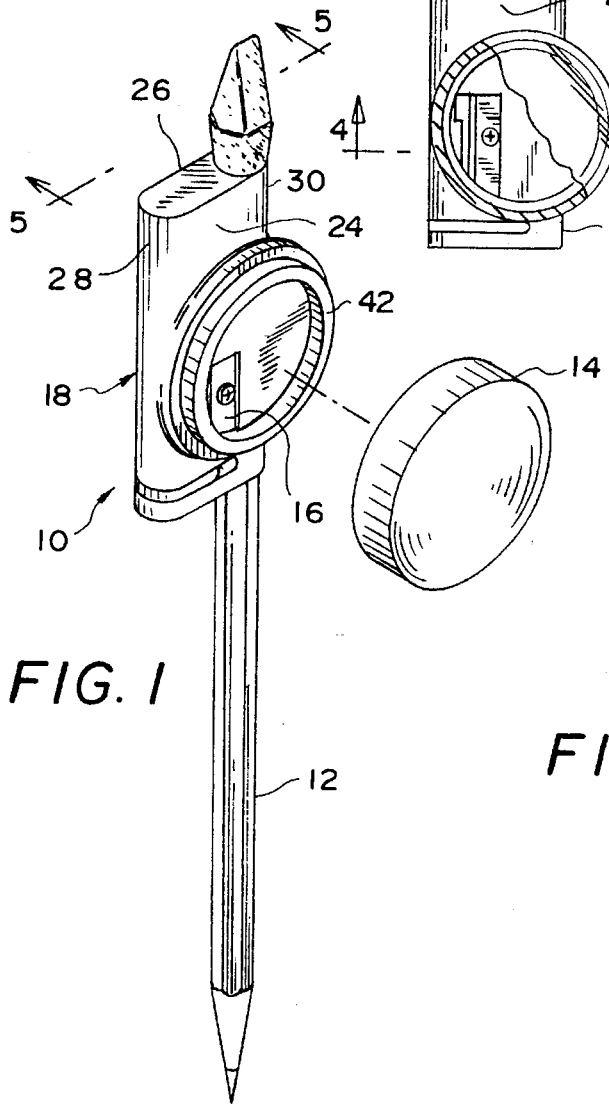
FIG. 1
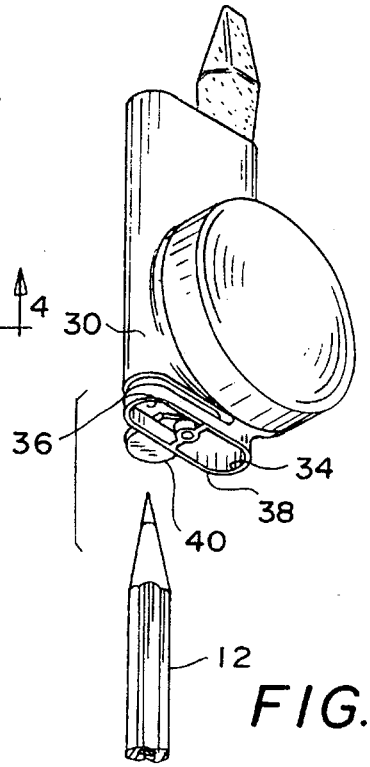
FIG. 3
FIG. 5
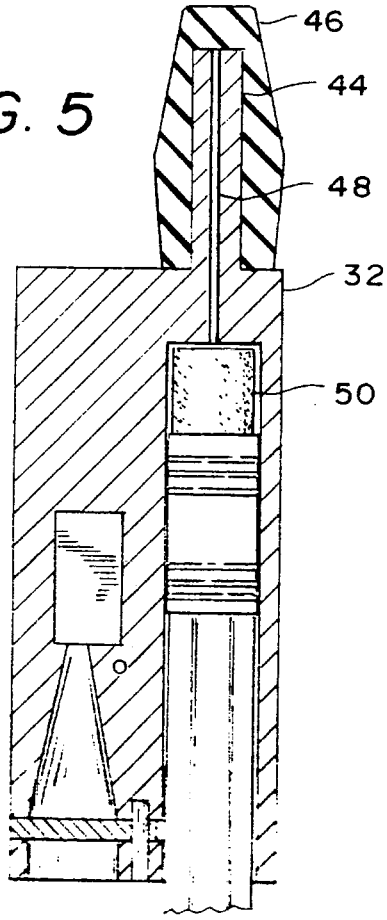
FIG. 4
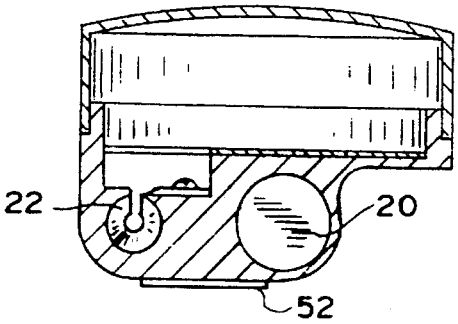

COMBINED PENCIL SHARPENER AND PENCIL STOWAGE APPARATUS

BACKGROUND OF INVENTION

1. Field of the Invention

The present invention relates generally to pencils and more particularly to pencil sharpening and pencil storage devices.

2. Description of the Related Art

Wooden pencils must be sharpened frequently and often get lost in briefcases or purses. They cannot be carried in one's pocket without leaving a graphite residue. Pencils may be carried in a shirt pocket by securing a clip with which the pencil may be secured, but there are still problems with graphite residue unless a shirt pocket protector is used. Frequent pencil sharpening usually requires leaving one's desk to use the wall or table mounted sharpener, or searching one's belongings to find a portable sharpener.

A patent search has revealed several patents which attempt to provide a solution to one or more of the above problems.

U.S. Pat. No. 5,205,664, discloses a rather complicated lead-auto-sharpened propelling pencil and a process of making it. U.S. Pat. No. 2,757,638, discloses a combined pencil sharpener, extension grip and eraser. U.S. Pat. No. 179,641, discloses a combined pencil case and sharpener provided with a shoulder and a flanged tube arranged with its mouth. U.S. Pat. No. 627,279, discloses a combined pencil-sharpener and eraser comprising a tube, adapted at one end to engage a tubular sleeve on the end of the pencil and at the other to carry an eraser, having its intervening portion flattened at each side and formed with a smaller, tubular section, slided longitudinally, and a knife having its body secured to one of the flattened portions and its blade bent over and projected through the slot. U.S. Pat. No. 2,333,714 discloses a pencil sharpener comprised of a tube, a blade disposed generally diagonally and diametrically within the tube fastened at opposite ends to the latter, the blade at its intermediate portion being narrow and free from the wall of the tube to provide room on all sides of the blade, and means to fasten the tube to a pencil.

SUMMARY OF THE INVENTION

The present invention is a combined pencil sharpener and pencil stowage apparatus. In its broadest aspects, the invention comprises a body, a pencil stowage compartment formed within the body for containing a tip of a pencil, and a separate pencil sharpener compartment formed within the body, the pencil sharpener compartment containing a pencil sharpener. Unlike previous inventions, the present invention provides a single body that has these two separate pencil stowage and pencil sharpener compartments formed therein.

The pencil stowage compartment and pencil sharpener compartment are preferably positioned in a parallel relationship to minimize the length of the pencil/apparatus when the pencil is stowed in the apparatus, therefore making it easy to be stored in the user's pocket.

Other objects, advantages and novel features of the present invention will become apparent from the following detailed description when considered in conjunction with the accompanying drawings.

BRIEF DESCRIPTION OF THE DRAWINGS

FIG. 1 is a front perspective view of a preferred embodiment of the present invention showing the pencil shaving trap cover removed to reveal the pencil sharpener and the pencil being stowed in the pencil stowage compartment.

FIG. 2 is a top plan view of the embodiment illustrated in FIG. 1.

FIG. 3 is a front and end perspective view of the apparatus shown with the pencil shaving trap cover engaged and a pencil in proximity to the pencil sharpener compartment.

FIG. 4 is a cross-sectional view taken along line 4—4 of FIG. 2.

FIG. 5 is a cross-sectional view taken along line 5—5 of FIG. 1.

The same elements or parts throughout the figures of the drawings are designated by the same reference characters.

DETAILED DESCRIPTION OF THE PREFERRED EMBODIMENT

Referring now to the drawings and the characters of reference marked thereon, FIG. 1 illustrates a perspective view of the combined pencil sharpener and pencil stowage apparatus of the present invention, designated generally as 10. The apparatus 10 is shown with a pencil 12 being stowed therein. A removable pencil shaving trap cover 14 is shown removed to reveal a pencil sharpener 16. As can be seen more clearly with reference to FIGS. 3, 4 and 5, the apparatus 10 includes a body designated generally as 18, a pencil stowage compartment 20 formed within the body 18 for containing a tip of a pencil 12, and a separate pencil sharpener compartment 22 formed within the body. Pencil sharpener compartment 22 contains the pencil sharpener 16. The pencil stowage compartment 20 and pencil sharpener compartment 22 are positioned in a parallel relationship so as to minimize the length of the pencil and apparatus while being stowed, i.e., carried in the user's pocket, briefcase, etc. Thus, the pencil stowage compartment defines a first longitudinal axis and the pencil sharpener compartment 22 defines a second longitudinal axis, the first and second longitudinal axes being spaced apart. The body 18 is elongated and defines an upper surface 24 and a lower surface 26 which are substantially rectangular as viewed projected on a flat surface. The sides 28, 30 are preferably curved to minimize space, prevent the user from being poked by a sharp surface, and for aesthetic appeal. Body 18 is preferably formed of a resilient plastic material.

Referring to FIG. 2 it can be seen that the body may be viewed as having a first end portion 30 and a second end portion 32. The first end portion 30 contains the pencil storage compartment 20 and the pencil sharpener compartment 22 in spaced parallel relationship. As can be seen in FIG. 3, end openings 34, 36 of each respective compartment 20, 22 are formed in an end face 38 of the first end portion 30 of the body 18. A rotatable dust retainer door 40 is preferably provided for sealing the pencil sharpener compartment 22. The pencil sharpener 16 may be secured to its position in the compartment 22 by bonding, screws or other conventional fastening means.

The shaving trap cover 14 is preferably friction or pressure fit to a circular flange 42 on the upper surface 24. Trapped cover 14 may be clear or opaque to provide viewing of the amount of shavings.

Referring now to FIG. 5, it may be seen that the second end portion 32 includes an eraser stub 44 for securing an eraser 46. Eraser 46 may be a conventional eraser commonly used on pencils. Pencil stub 44 preferably has a longitudinal axis coincident with the longitudinal axis of the pencil stowage compartment 20. A through-hole 48 is formed through the entire length of the eraser stub 44 along its longitudinal axis. The through-hole 48 continues through the second end portion 32 of the body 18 so as to allow the removal of the pencil eraser 50 with a very thin object in the event that it gets jammed.

Referring again now to FIG. 4, it can be seen that a magnet 52 is preferably attached to an outer surface of the body 18 to provide convenient attachment to other objects.

The built-in pencil sharpener with shavings trap of the present invention provides the user with a sharp point at all times. There is no need to locate a pencil sharpener or leave one's desk. Furthermore, the pencil will not roll off a sloped desk with the apparatus 10 attached.

It is understood that the pencil may carry the apparatus 10 in the orientation noted in FIG. 5 while the pencil is being used. However, the pencil may be reorientated so that the pencil tip is in the storage compartment 20 when the pencil is not in use and stored, for example, in the pocket. The piggy back arrangement provided by the present invention allows for the convenient availability of the pencil sharpener. The apparatus 10 can be easily located where pencils are often needed (e.g., refrigerators, clipboards or phones).

The apparatus 10 can be shaped in ways which make it more appealing by putting animal faces, or other desired objects on it.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A combined pencil sharpener and pencil stowage apparatus, comprising:

a) a body;

b) a pencil stowage compartment formed within said body for containing a sharpenable tip of a pencil;

c) a separate pencil sharpener compartment formed within said body, said pencil sharpener compartment containing a pencil sharpener and a volume for retaining pencil shavings; and d) an openable pencil shaving trap cover engageable with said body and associated with said pencil sharpener compartment for holding pencil shavings.

2. The apparatus of claim 1 wherein said pencil stowage compartment and said pencil sharpener compartment are positioned in a parallel relationship.

3. The apparatus of claim 2 wherein said pencil stowage compartment defines a first longitudinal axis and said pencil sharpener compartment defines a second longitudinal axis, said first and second longitudinal axes being spaced apart.

4. The apparatus of claim 1 further including an eraser stub extending from said body for containing a removable pencil eraser.

5. The apparatus of claim 1 wherein said body is elongated and has a first end portion and a second end portion, said first end portion containing said pencil stowage compartment and said pencil sharpener compartment, said compartments defining first and second axes in spaced parallel relationship, each compartment being elongated, end openings of each respective compartment formed in an end face of said first end portion of said body.

6. The apparatus of claim 5 further including an eraser stub extending from said second end portion of said body, said stub extending parallel to first and second axes.

7. The apparatus of claim 6 wherein said eraser stub has a longitudinal axis coincident with the longitudinal axis of said pencil stowage compartment, a through-hole formed through the entire length of said eraser stub along its longitudinal axis and continuing through said body to said pencil stowage compartment so as to allow the removal of the pencil eraser in the event that it gets jammed.

8. The apparatus of claim 5 wherein said body defines an upper surface for supporting a removable pencil shaving trap cover.

9. The apparatus of claim 5 further including a movable dust retainer door for sealing said pencil sharpener compartment.

10. The apparatus of claim 5 wherein body defines an upper surface and a lower surface, said upper and lower surfaces being substantially rectangular, as viewed as projected on a flat surface.

11. The apparatus of claim 1 further including a magnet attached to an outer surface of said body.

* * * * *